US006133828A

United States Patent [19]

Payne

[11] Patent Number: 6,133,828

[45] Date of Patent: Oct. 17, 2000

[54] FIRE DETECTION AND ALARM SYSTEM WITH SELECTIVE FIRE WARNING

[75] Inventor: Roger Dennis Payne, Havant, United Kingdom

[73] Assignee: Apollo Fire Detectors Limited, Hampshire, United Kingdom

[21] Appl. No.: 09/408,976

[22] Filed: Sep. 29, 1999

[30] Foreign Application Priority Data

Sep. 30, 1998 [GB] United Kingdom ..... 9821189

[51] Int. Cl.[7] ..... G08B 29/00

[52] U.S. Cl. ..... 340/506; 340/511; 340/533; 340/310.01; 340/310.05

[58] Field of Search ..... 340/506, 511, 340/533, 310.01, 310.05

[56] References Cited

U.S. PATENT DOCUMENTS 4,812,821 3/1989 Santy et al. .
4,949,359 8/1990 Voillat .
5,705,979 1/1998 Fierro et al. .

FOREIGN PATENT DOCUMENTS 0 319 266 A2 6/1989 European Pat. Off. .
0 396 386 A2 11/1990 European Pat. Off. .

*Primary Examiner*—Daryl Pope
*Attorney, Agent, or Firm*—R. Lewis Gable; Cowan, Liebowitz & Latman, PC

[57] ABSTRACT

A fire detection and alarm system has fire detecting devices of different types (T1,T2) and alarm means connected across supply lines. Both types of device normally apply a high impedance across the supply lines in a standby condition, and a low impedance in an alarm condition. The fire detecting devices are operable by a first voltage. This is lower than a second voltage applied, by a CCU, to the lines in an alarm condition for operating the alarm means. The alarm means respond to operating current supplied under different conditions to give respectively different kinds of fire warnings. Each first and second type of fire detecting device has current limiting means for differently limiting the respective current drain on the supply lines in the alarm condition. The CCU is operable to cause the supply line voltage to be momentarily reduced below the second voltage, so that the alarm means is momentarily deactivated, whereby the CCU can then respond to the supply line voltage, due to the respective current drain of the current limiting means, so as to apply the operating current to the alarm means to give the required fire warning. This enables priority to be given to a manual call point.

8 Claims, 5 Drawing Sheets

IONISATION SMOKE DETECTOR

MANUAL CALL POINT

IONISATION SMOKE DETECTOR

FIRE DETECTION AND ALARM SYSTEM WITH SELECTIVE FIRE WARNING

CROSS-REFERENCE TO RELATED APPLICATION

The following application relates to this application and is incorporated herein by reference: U.S. patent application Ser. No. 09/292,199, entitled "Detecting Device and Alarm System", filed Apr. 15, 1999 in the name of Roger Dennis Payne, and corresponding to GB Patent Application Serial No. 9808094.8, filed Apr. 16, 1998.

FIELD OF INVENTION

This invention relates to a fire detection and alarm system with a selective fire warning. The invention can be used in a system which includes, for example, fire detecting devices and alarm means connected across the same pair of supply lines. The fire detecting devices include one or more of a first type, such as a smoke detector, and one or more devices of a second type, such as a manual call point. (In the latter respect, a fire is detected by virtue of pressing a button, rather than by sensing some change in a parameter, or in an environment, such as smoke or flame). The invention can be used so as to cause the alarm means to be selectively operated so as to give a required fire warning. For example, the fire warning may be of an "alert" variety, when at least one device of the first type has been actuated, but it may be an "evacuate" type of warning, when any device of the second type has been actuated. The arrangement may be such that one kind of fire warning, such as "evacuate", is given priority over another kind of warning, such as "alert". Further details of the present invention are given below but, as a background to the invention, some prior art systems will first be described.

DESCRIPTION OF BACKGROUND OF THE INVENTION

FIG. 1*a* shows a schematic circuit diagram of a first known type (T1) of fire detecting device, which includes an ionisation chamber C for detecting smoke. In this type T1 of detector, a threshold voltage of a zener diode ZD1 is selected according to the parameter which is sensed, e.g. smoke, heat, flame or some other parameter. FIG. 1*b* is a circuit diagram of another type T2 of fire detecting device, i.e. a manual call point which includes a switch 3 in series with a zener diode ZD2. Both of these devices can be connected via terminals L1, L2 to a pair of supply lines 7 (shown in FIG. 2) to which is also connected a central control unit (CCU) 6, of conventional construction. Each type T1,T2 of detecting device applies a high impedance across the supply lines 7 in a standby condition, but is responsive to a change in state, due to a fire condition, to apply a low impedance across the supply lines 7 in an alarm condition. The CCU 6 provides a current supply on the lines at a voltage which is higher than the threshold voltage of the zener diodes ZD1, ZD2, the supply being current limited by a resistor (not shown), or other means to prevent the power dissipation rating of the zener diodes being exceeded in an alarm condition.

In FIG. 1*a*, resistor 4 is shown connected in parallel with zener diode ZD1, so as to maintain thyristor 5 in a latched state, in the event that the supply voltage becomes less than the threshold voltage of the zener diode ZD1. This may occur when a second detecting device (not shown), connected to the same line 7 and having a slightly lower threshold voltage zener diode, also detects a fire.

FIG. 2 is a schematic diagram of a known fire detection and alarm system in which CCU 6 is shown connected via lines 7 to a first type of detecting device T1 (similar to that shown in FIG. 1*a*) and a second type of detecting device T2 (similar to that shown in FIG. 1*b*). Alarm devices 10 are shown connected to the CCU 6 by a second pair of supply lines 8. The CCU 6 includes voltage threshold sensing means (not shown) responsive to the voltage across lines 7, i.e. at points A and B, and switching means (not shown) responsive to the voltage threshold sensing means which activates the alarm devices 10 to produce an alert or evacuate warning, according to the voltage across lines 7, when a fire has been detected. In this alarm condition, the detecting devices T1, T2 provide different low impedances across the lines 7 which limit the voltage across lines 7 to different voltages determined by, for example, the use of zener diodes with different zener voltages in the detecting devices T1, T2.

FIG. 3 shows a known current/voltage characteristic 11 of the first type of detecting device T1 (e.g. a smoke detector). Characteristic 12 is that of a second type of detecting device T2 (e.g. a manual call point). These characteristics would be obtained when either device T1 or T2 is in an alarm condition. FIG. 3 also shows an example of a load-line characteristic of the output of the CCU to the fire detection devices. Characteristic 13 is that of a supply which is derived, for example, from a voltage source of 24 volts connected in series with a 600 ohm resistor. In the alarm condition, the voltage across the supply and signalling lines is the voltage at which the characteristic of the fire detecting device intersects the CCU load-line. In the standby condition, the voltage across A and B is 24 volts. When only the first type of detecting device T1 (the smoke detector) is in the alarm condition, the voltage across A and B is 15 volts and the CCU switches the alarm devices 10 to signal an "alert". However, whenever the second type of detecting device T2 (a manual call point) is in the alarm condition, the voltage across A and B is reduced to 10 volts and the CCU switches the alarm devices to signal "evacuate".

A disadvantage of the system described above is that separate lines are needed for fire detecting devices and alarm devices. This is because detecting devices in the alarm condition would be damaged by the high current available from the supply applied to the lines to operate alarm devices.

Our copending UK application No. 9808094.8 (corresponding to U.S. Application Ser. No. 09/292,199), to which reference may be made for further details, discloses a detecting device comprising signalling means for producing a change of state signal, from a quiescent state to an alarm state, when a change in condition or environment occurs, no such change normally occurring in the quiescent state. The detecting device also has impedance switching means with high and low impedance states which are applied across terminals for connection to supply lines. The impedance switching means is normally in a high impedance state when the signalling means is in its quiescent state, but responds to a change of state signal, from the signalling means, so as to switch to a low impedance state. The low impedance state increases current drain on the supply lines so that it is recognisable as a fire detection signal. The detecting device normally operates with a first voltage present on the supply lines. However, an alarm device is actuated when a second voltage, higher than the first voltage, is applied to the supply lines. The detecting device further includes voltage responsive means, which respond to the second voltage, to cause the impedance switching means to switch to a high impedance state, so that the line impedance across the supply line terminals is increased, so as to reduce current drain and thereby conserve power. Thus, when the alarm condition exists, the alarm device can be provided with a relatively high operating current at the second voltage, in order to give a fire warning, but the current drain by the detecting device is reduced to a minimum, to conserve available power. This is important when the power supply is a battery, because it can extend the life of the battery under the alarm condition.

In a preferred embodiment disclosed in the same copending UK 9808094.8 (corresponding to U.S. Application Ser. No. 09/292,199), means are provided for generating an "alert" signal when a smoke detector is in an alarm condition, and an "evacuate" signal whenever a manual call point is in an alarm condition. A disadvantage of the means disclosed in the copending application is that the identification of the signal from a manual call point involves reversing the polarity of the voltage applied to the supply lines, thereby increasing CCU complexity and cost. A further disadvantage is that polarity must be observed when connecting smoke detectors to the supply lines and this can lead to errors during installation.

In other systems, such as that described in GB2178878 and generally known as analogue addressable fire detection and alarm systems, a digital communications protocol is used by the fire detecting devices to signal to a CCU a code which identifies the type of detecting device that is transmitting a fire detection signal and a change of the parameter which is being monitored (e.g. smoke). The CCU in such a system can use the communications protocol to send signals to alarm devices which are activated according to the type of detector that has signalled the change in parameter being monitored. However, analogue addressable systems require more complex and more expensive electronics in detecting devices, alarm devices and the CCU, than in conventional, i.e. non-addressable systems which use conventional, non-addressable fire detecting devices, having only two or three operating states.

Despite various attempts, in the past, to solve problems of giving priority to a signal from a particular type of fire detector over a signal from another type of fire detector, in systems where fire detectors and alarm devices are operated on the same two wire supply, no satisfactory solution has been found. At least in its preferred embodiments, the present invention provides a solution to this problem which has the advantage of simple and low-cost construction and which can also employ robust electronics in the circuitry of the fire detectors, alarm devices and CCU.

OBJECTS OF INVENTION

An object of the present invention is to solve these problems and to provide a system of simple and low cost.

BRIEF SUMMARY OF INVENTION

According to the invention, a fire detection and alarm system comprises:

a pair of supply lines;

fire detecting devices connected across said supply lines, at least one of said devices being of a first type, and at least another of said devices being of a second type, both the first and second types of device being operable by a first voltage in a first voltage range;

both the first and second types of device normally applying a high impedance across the supply lines in a standby condition, but being responsive to a change in state, due to a fire condition, to apply a low impedance across the supply lines in an alarm condition, alarm means connected across the same supply lines and operable at a second voltage higher than the first voltage and in a second voltage range, said alarm means being responsive to operating current, when supplied with different voltages, or polarities, or both, to give respectively different kinds of fire warnings;

a central control unit (CCU) which is connected to the supply lines to supply suitable operating current in the first and second voltage ranges, so that:

(a) in the standby condition, the voltage across the supply lines is within the first voltage range;

(b) in the alarm condition, the voltage across the supply lines is within the second voltage range;

each first and second type of fire detecting device having voltage responsive means which respond to the second voltage to cause a high impedance to be applied across the supply lines, so as to limit the respective current drain on the supply lines when the fire detecting devices are in the alarm condition, the voltage responsive means being such that the voltage/current characteristic of said first type differs from that of said second type, below the first voltage range, so that the CCU is operable to cause the supply line voltage to be momentarily reduced below the first voltage range, whereby the alarm means is momentarily deactivated, so that the CCU can then respond to the supply line voltage or current of the respective detecting device or devices in order to apply the operating current to the alarm means, with the voltage or polarity which gives the required fire warning.

The fire detecting devices are preferably latched in the alarm condition so that they continue to signal a fire despite any variation, such as a change in the monitored parameter or in supply line voltage. Whereas latching circuitry can be included in say a smoke detector (as described in our copending UK application 9808094.8, corresponding to U.S. Application Ser. No. 09/292,199), the concept of being latched applies also to a manual call point, e.g. where a button is pressed and stays in, thereby continuing to remain in a switching state that represents the alarm condition. Moreover, the manual call point can be considered to be operable by the first voltage, since it requires a voltage to exceed the zener threshold and to provide a current drain in its low impedance state.

The different types of detecting devices can include, for example, smoke detectors, flame detectors and manual call points. However, the first and second types of detecting device could be of generally similar construction, except for the respective current limiting means, since one may be used to monitor one environment where another could be used to monitor another environment. Therefore, the construction of the detecting device is relatively unimportant, as long as it provides a change from a high impedance to a low impedance condition as a result of being actuated from a standby to an alarm condition and its voltage responsive means enables it to be identified as one type or the other.

The alarm means may be a single device which is capable of giving different kinds of fire warnings, but it can also be several alarm devices which give respective kinds of fire warnings. Also, there may be more than one alarm device giving the same kind of warning, for example, where it is necessary to generate an evacuate signal on each floor of a large building. Generally speaking, the alarm means is initially operable at a second voltage which is higher than the first voltage so that it is not actuated unless and until an alarm condition exists. It may initially signal a priority condition, such as "evacuate", or a lower priority "alert". Generally speaking, the alarm means responds to operating current which is supplied, under different conditions, so as to give respectively different kinds of fire warnings. For example, the voltage may be changed or the polarity of the current may be reversed in order to cause the alarm means to give a different kind of warning. Therefore, the condition under which operating current is supplied enables the alarm means to be actuated so as to give the required kind of fire warning. The fire warning may be a sound signal, such as a siren, bell or buzzer, and/or it may include a visual warning, such as flashing lights, and/or it may include verbal instructions for occupants of buildings to take appropriate action, such as evacuation, following a predetermined fire escape route, etc, and/or it may include telephoning the Fire Brigade.

The CCU is preferable operable so as to cause the alarm means to operate so that priority is given to one of the types of fire detecting devices. For example, if the second type of fire detecting device is a manual call point, this can be accorded priority over the first type, which may be a smoke detector. This can be achieved by enabling the CCU to detect a different voltage, e.g. when the line voltage is momentarily reduced to examine the voltage on the supply lines (the line voltage will differ due to the different zener diode thresholds, even where the first type is in the alarm state before the second type). However, in some cases, giving priority may not be essential, since different types of warning could be given according to which type of detector is in the alarm state. In the case of priority, the first type of detecting device could be, for example, a smoke detector which, when in the alarm condition, causes a timer to commence a countdown before an alarm signal is transmitted to fire fighting services. The second type of detecting device can be a manual call point which overrides the timer so as to cause an evacuate warning to be given without waiting for the end of the timed period.

According to a preferred embodiment of the invention, a fire detection and alarm system comprises a central control unit (CCU) connected to more than one type of fire detector and at least one alarm device by a pair of supply lines supplying operating current at a first voltage to the fire detectors and alarm devices, the supply lines being used to signal current drain in any fire detector as a fire detection signal, the fire detectors operating when a first voltage is present on the supply line and the alarm devices activating when a second voltage, which is higher than the first voltage is present on the supply lines; each type of detector including:

first circuit means (Ref: FIG. 4, T9, T8, R15) for limiting the current drain of a fire detection signal over a first voltage range including the first voltage, second circuit means (ZD3, R10,R11, T7) for reducing the current drain of the fire detection signal to a low value over a second voltage range, substantially contiguous with the first voltage range and including the second voltage, third circuit means (ZD4, R13, T9) for reducing the current drain of the fire detection signal to a low value over a third voltage range substantially contiguous with the first voltage range and wherein all voltages in the third voltage range are lower than the lowest voltage in the first voltage range, characterised in that:

all fire detectors of a first type have substantially the same lowest voltage in the first voltage range, this lowest voltage being substantially different from and lower than the lowest voltage in the first voltage range of all other types of detector connected to the supply lines; and that the output impedance of the CCU when supplying current supporting a fire signal is conditioned to limit the supply current to a value less than the current drain of a fire signal from a fire detector of the first type supplied with a voltage at its lowest voltage in the first voltage range, and greater than the current drain of a fire signal from a fire detector of the first type supplied with a voltage less than the highest voltage in its third voltage range; and that the current drain of a fire signal from detectors of types other than the first type when supplied with a voltage equal to or close to the lowest voltage in the first voltage range of a fire detector of the first type is less than the current drain of a fire detector of the first type under the same supply voltage conditions, such that the voltage on the supply lines when a fire detector other than that of the first type is signalling a fire alarm is greater than the voltage on the supply lines whenever a fire detector of the first type is signalling a fire alarm, whereby an alarm from a fire detector of the first type can always be recognised and accorded priority, the voltage on the supply lines when a detector of the first type signals a fire condition is less than and distinguishable from the voltage on the supply lines when a detector of any other type signals a fire condition, thereby enabling a fire signal from a fire detector of the first type always to be recognised and accorded priority.

In another preferred embodiment of the invention, the current drain of a fire signal from detectors of types other than the first type, when supplied with a voltage equal to or close to the lowest voltage in the first voltage range of a fire detector of the first type, is less than one tenth of the current drain of a fire detector of the first type under the same supply voltage conditions, such that a fire signal from a detector of the first type can be recognised when ten or more detectors of any other type(s) simultaneously signal fire.

In another preferred embodiment, detectors of the first type are manual call points.

Embodiments of the invention will now be described with reference to some of the accompanying drawings, in which drawings:

FIG. 1*a* is a circuit diagram of a known ionisation smoke detector;

FIG. 1*b* is a circuit diagram of a known manual call point;

DETAILED DESCRIPTION OF A PREFERRED EMBODIMENT OF THE INVENTION

Figure 1B:
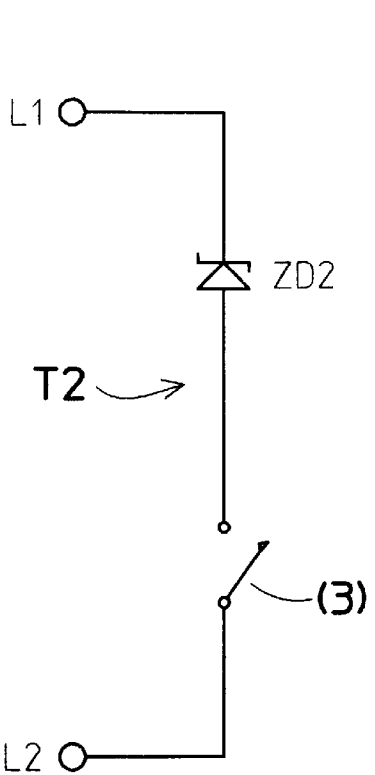
Figure 1A:
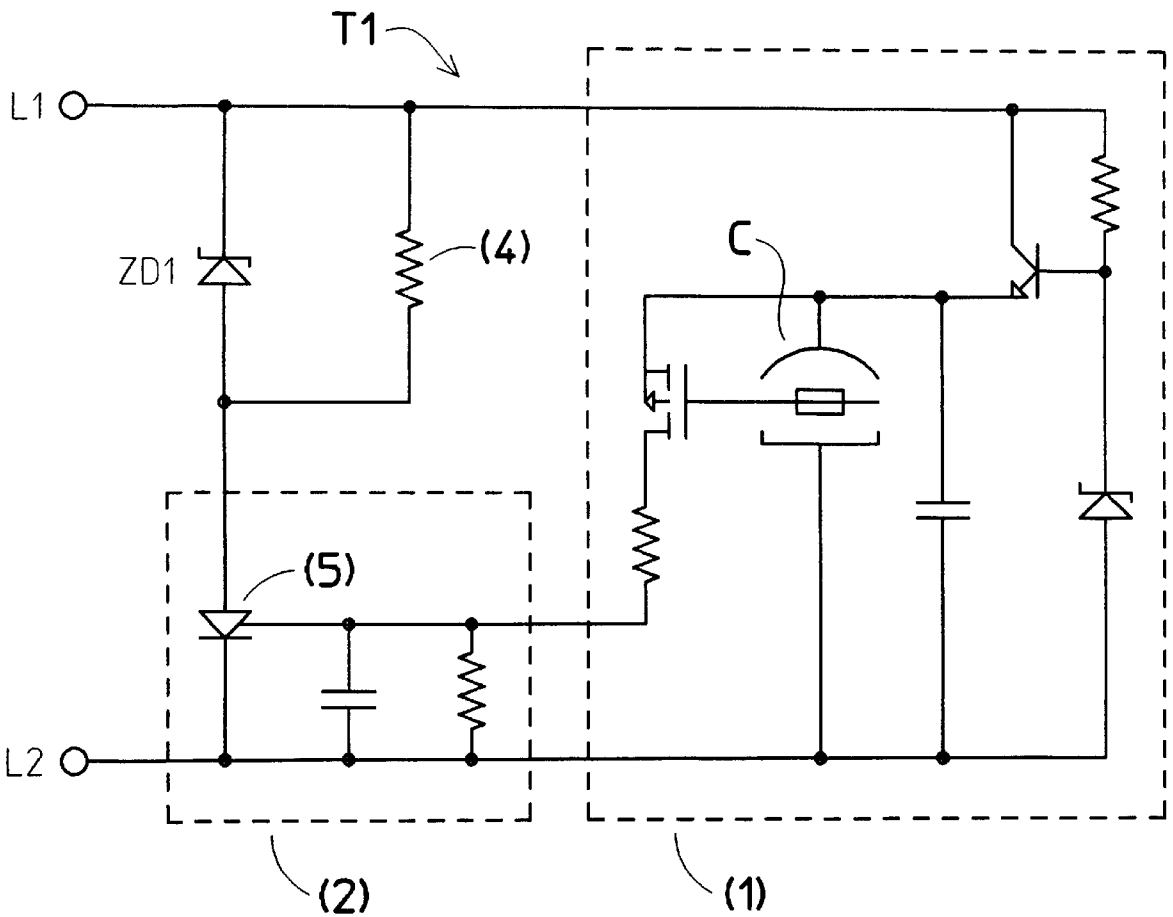
Figure 2:
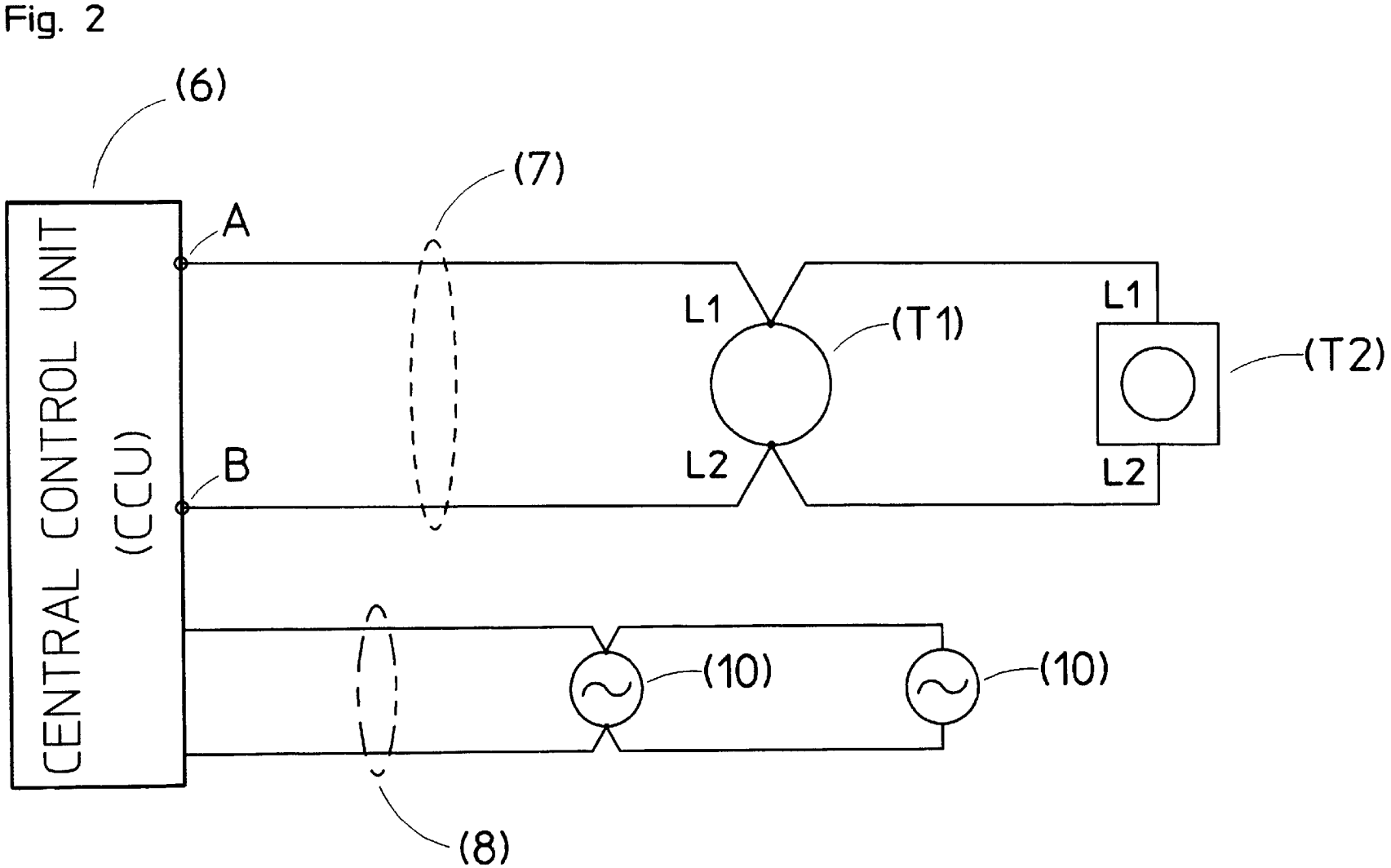
FIG. 2 is a schematic diagram showing a typical fire alarm system incorporating fire detecting devices and alarm devices.
Figure 3:
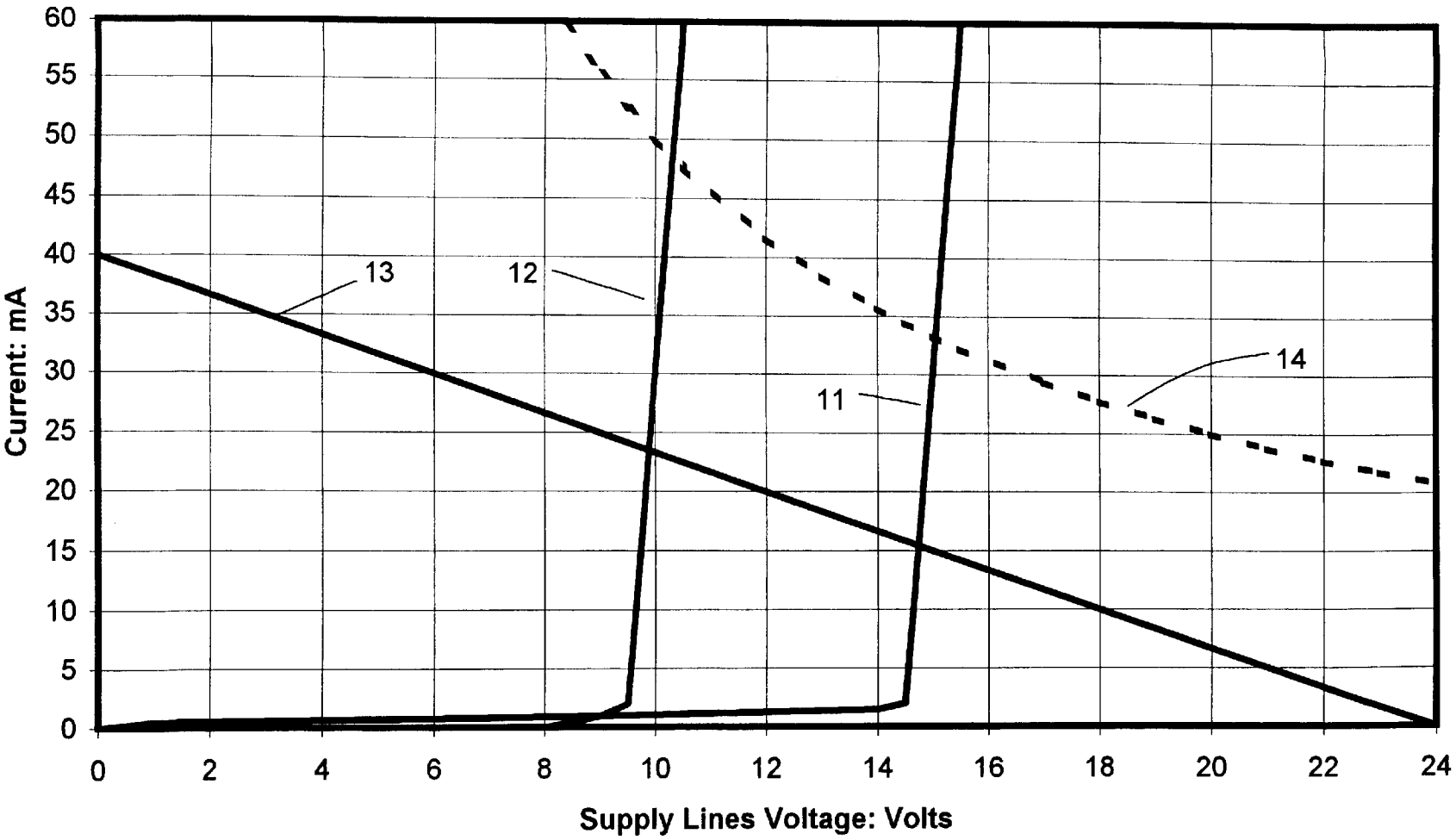
FIG. 3 is a graph showing current (mA) plotted against voltage for a fire alarm system of the two wire type described herein.
Figure 4:
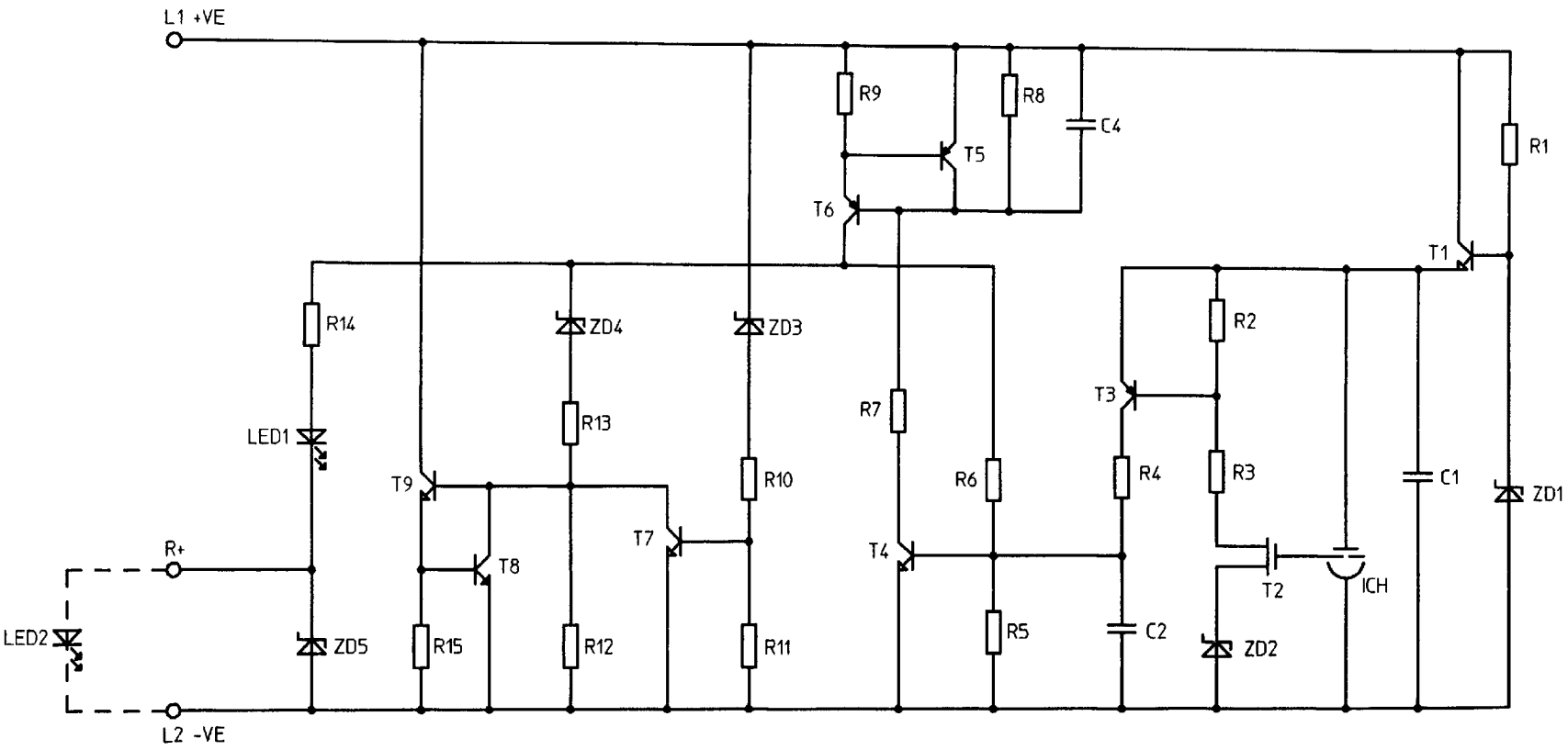
FIG. 4 is a circuit diagram of an embodiment of the invention.

Referring to FIG. 4, this is a circuit diagram of a fire detecting device which can be used in an embodiment of the invention. A detailed description of the circuitry is given in our copending UK application No. 9808094.8 (corresponding to U.S. Application Ser. No. 09/292,199). However, the modification according to the present invention means that in detectors of the first type, the voltage threshold of zener diode ZD4 is made significantly less than the voltage threshold of the zener diode ZD4 in the second type of detector. Hence the circuitry is generally the same, apart from the threshold voltage of the zener diode which characterises the detector type.

Figure 5:
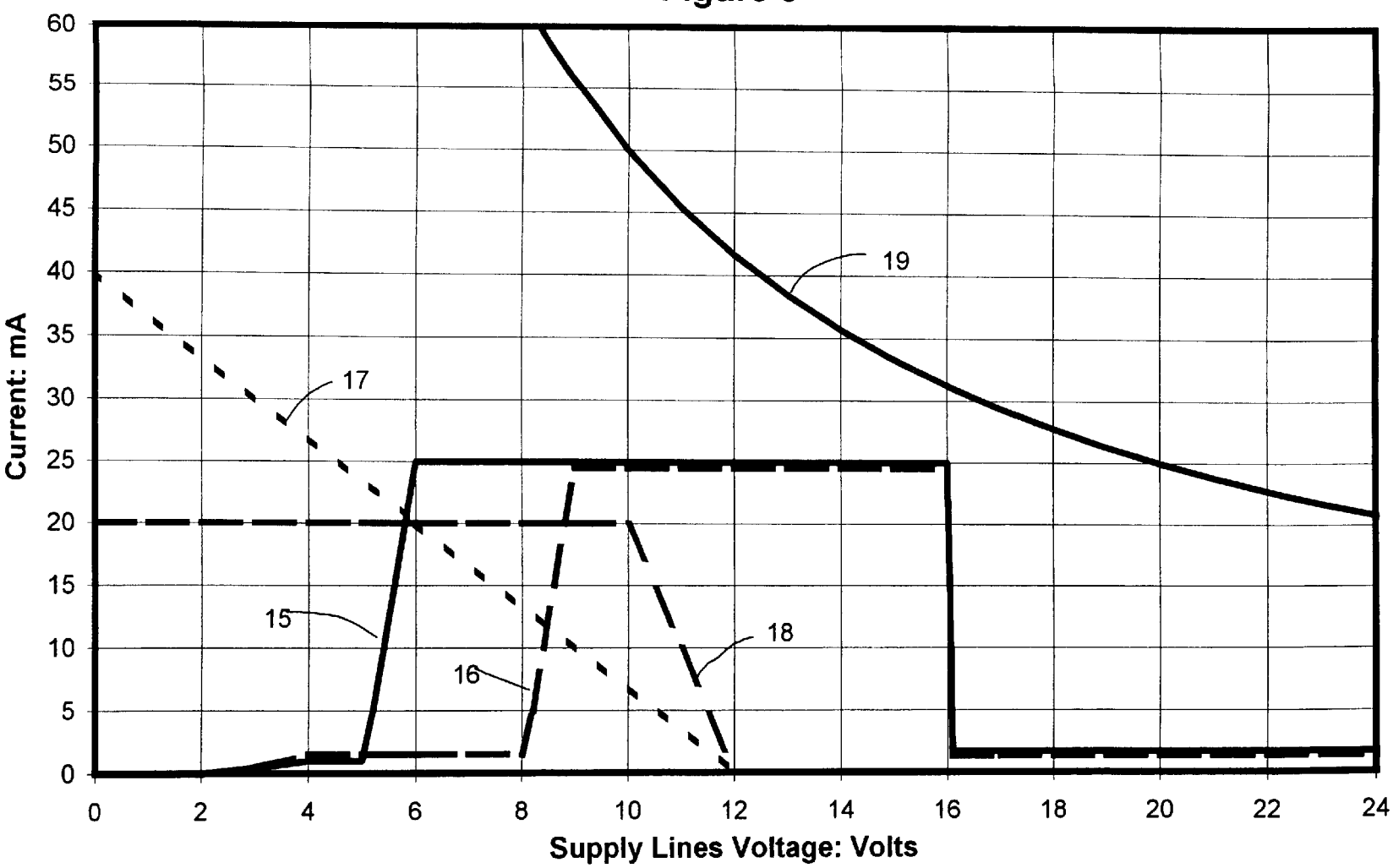
FIG. 5 shows another graph of current (mA) against voltage, for a fire alarm system which embodies the invention.

FIG. 5 shows a typical current/voltage characteristic of fire detecting devices in an alarm condition. Characteristic 15 is that of a first type of detecting device and characteristic 16 is that of a second type of detecting device. Characteristic 17 shows a typical current/voltage load-line characteristic of a CCU in an embodiment of the invention, with a resistive internal impedance in series with a source voltage equal to the first voltage. Characteristic 18 shows a typical current/voltage load-line characteristic of a CCU in an embodiment of the invention with a substantially voltage independent current limiting means in series with a source voltage equal to the first voltage. In both cases the voltage developed across the supply lines is equal to the lowest voltage at which the CCU load-line intersects a detector characteristic, i.e. the intersection which drains the highest current. FIG. 5 also shows that the current drain in the alarm condition of both types of detecting device is within the 0.5 watt power limit curve 19.

What is claimed is:

1. A fire detection and alarm system comprises:

a pair of supply lines;

fire detecting devices connected across said supply lines, at least one of said devices being of a first type, and at least another of said devices being of a second type, both the first and second types of device being operable by a first voltage in a first voltage range;

both the first and second types of device normally applying a high impedance across the supply lines in a standby condition, but being responsive to a change in state, due to a fire condition, to apply a low impedance across the supply lines in an alarm condition, an alarm device or devices connected across the same supply lines and operable at a second voltage higher than the first voltage and in a second voltage range, said alarm device(s) being responsive to operating current, when supplied with different voltages, or polarities, or both, to give respectively different kinds of fire warnings;

a central control unit (CCU) which is connected to the supply lines to supply suitable operating current in the first and second voltage ranges, so that:

(a) in the standby condition, the voltage across the supply lines is within the first voltage range;

(b) in the alarm condition, the voltage across the supply lines is within the second voltage range;

each first and second type of fire detecting device having a voltage responsive device which respond to the second voltage to cause a high impedance to be applied across the supply lines, so as to limit the respective current drain on the supply lines when the fire detecting devices are in the alarm condition, the voltage responsive device being such that the voltage/current characteristic of said first type differs from that of said second type, below the first voltage range, so that the CCU is operable to cause the supply line voltage to be momentarily reduced below the first voltage range, whereby the alarm device(s) is momentarily deactivated, so that the CCU can then respond to the supply line voltage or current of the respective detecting device or devices in order to apply the operating current to the alarm device(s), with the voltage or polarity which gives the required fire warning.

2. A system according to claim 1, wherein the first and second detecting devices each include a latching for latching the device in the alarm condition, the voltage responsive device being connected to the respective latch in each detecting device.

3. A system according to claim 1, wherein the fire detecting devices of the first and second types include a manual call point and a device having a fire sensor.

4. A system according to claim 1, wherein the CCU is operable so as to cause the alarm device(s) to operate so that priority is given to one of the types of fire detecting devices.

5. A system according to claim 1, wherein the alarm device(s) is either a single device which is capable of giving different kinds of fire warnings, or several alarm devices which give respective kinds of fire warnings.

6. A fire detection and alarm system comprising a central control unit (CCU) connected to more than one type of fire detector and at least one alarm device by a pair of supply lines supplying operating current at a first voltage to the fire detectors and alarm devices, the supply lines being used to signal current drain in any fire detector as a fire detection signal, the fire detectors operating when a first voltage is present on the supply line and the alarm devices activate when a second voltage, which is higher than the first voltage is present on the supply lines; each type of detector including:

a first circuit for limiting the current drain of a fire detection signal over a first voltage range including the first voltage, a second circuit for reducing the current drain of the fire detection signal to a low value over a second voltage range, substantially contiguous with the first voltage range and including the second voltage, a third circuit for reducing the current drain of the fire detection signal to a low value over a third voltage range substantially contiguous with the first voltage range and wherein all voltages in the third voltage range are lower than the lowest voltage in the first voltage range, characterised in that:

all fire detectors of a first type have substantially the same lowest voltage in the first voltage range, this lowest voltage being substantially different from and lower than the lowest voltage in the first voltage range of all other types of detector connected to the supply lines; and that the output impedance of the CCU when supplying current supporting a fire signal is conditioned to limit the supply current to a value less than the current drain of a fire signal from a fire detector of the first type supplied with a voltage at its lowest voltage in the first voltage range, and greater than the current drain of a fire signal from a fire detector of the first type supplied with a voltage less than the highest voltage in its third voltage range; and that the current drain of a fire signal from detectors of types other than the first type when supplied with a voltage equal to or close to the lowest voltage in the first voltage range of a fire detector of the first type is less than the current drain of a fire detector of the first type under the same supply voltage conditions, such that the voltage on the supply lines when a fire detector other than that of the first type is signalling a fire alarm is greater than the voltage on the supply lines whenever a fire detector of the first type is signalling a fire alarm, whereby an alarm from a fire detector of the first type can always be recognised and accorded priority, the voltage on the supply lines when a detector of the first type signals a fire condition is less than and distinguishable from the voltage on the supply lines when a detector of any other type signals a fire condition, thereby enabling a fire signal from a fire detector of the first type always to be recognised and accorded priority.

7. A system according to claim 6, wherein the current drain of a fire signal from detectors of types other than the first type, when supplied with a voltage equal to or close to the lowest voltage in the first voltage range of a fire detector of the first type, is less than one tenth of the current drain of a fire detector of the first type under the same supply voltage conditions, such that a fire signal from a detector of the first type can be recognised when ten or more detectors of any other type(s) simultaneously signal fire.

8. A system according to claim 6, wherein detectors of the first type are manual call points.

* * * * *